United States Patent [19]

Smith, Jr.

[11] Patent Number: 4,713,859

[45] Date of Patent: Dec. 22, 1987

[54] PORTABLE CLEANING CONTAINER

[76] Inventor: Don A. Smith, Jr., 811 Mockingbird La., Norman, Okla. 73071

[21] Appl. No.: 904,164

[22] Filed: Sep. 5, 1986

[51] Int. Cl.[4] ..... A47L 13/50

[52] U.S. Cl. ..... 15/264

[58] Field of Search ..... 15/260–264

[56] References Cited

U.S. PATENT DOCUMENTS 4,135,269 1/1979 Marston ..... 15/264

*Primary Examiner*—Edward L. Roberts

*Attorney, Agent, or Firm*—Glen M. Burdick

[57] ABSTRACT

An improved portable cleaning station for use with a conventional mop device and wringer device to clean floors and other surfaces. The portable cleaning station comprises a bucket assembly for containing a cleaning solution and having a drain opening formed in its lowermost portion; a valve assembly supported by the bucket assembly so as to communicate with the drain opening and selectively opening and closing the drain opening; and a filter assembly supported by the bucket assembly, the filter assembly selectively movable between an extended position (wherein a filtering element is disposed below the valve assembly and in a filter relationship therewith) and a retracted position (wherein the filtering element is disposed in a protected position beneath the bucket assembly).

22 Claims, 11 Drawing Figures

PORTABLE CLEANING CONTAINER

BACKGROUND OF THE INVENTION

1. Field of the Invention

The present invention relates generally to the field of containers, and more particularly, but not by way of limitation, to portable bucket-like containers for use in cleaning of floors.

2. Brief Description of the Prior Art

The use of containers, such as buckets, to hold cleaning solutions used in the cleaning or mopping of floors has long been practiced. Many types of containers have heretofore been employed, and in recent years some containers have been modified with wheels or castors to assist in the movement of the container over the floor from one location to another. While numerous body styles have heretofore been proposed for such containers, the prior art containers have generally failed to address and solve problems relating to the comfort and ease of the person using the container. The prevention of clogging of drains when the container solutions are disposed, including insoluble materials such as contaminants, mop strings and the like in the drain, has been a particular annoyance. Further, after use it is often difficult to sanitize the container and to remove residual insoluble materials therefrom.

Therefore, a need has long been recognized for an improved container for use in the cleaning or mopping of floors which solve these and other problems associated with conveniently and safely disposing of used cleaning solutions. It is to such a portable cleaning station that the subject invention is directed.

SUMMARY OF THE INVENTION

The present invention provides an improved portable cleaning station useful, in combination with a conventional mop device and wringer device, for the cleaning of floors and other surfaces. Broadly, the portable cleaning station comprises a bucket assembly for containing a cleaning solution and having a drain opening formed in its lowermost portion; a valve assembly supported to communicate with the drain opening for selectively opening and closing the drain opening; and a filter assembly for removing insoluble debris from the solution discharged from the drain opening. The filter assembly, supported beneath the drain, is selectively movable between an extended position and a retracted position.

An object of the present invention is to provide an improved portable cleaning station for holding cleaning solutions used in cleaning operations and which minimizes the necessity of a person handling or otherwise being contacted by the contents therefrom.

Another object of the present invention, while achieving the above stated object, is to provide an improved portable cleaning station which substantially eliminates particulate materials from being discharged to a disposal receptacle.

Another object of the present invention, while achieving the above mentioned objects, is to provide an improved portable cleaning station which can readily be cleansed to remove contaminants prior to storage.

Another object of the present invention, while achieving the above mentioned objects, is to provide a portable cleaning station which is economical to manufacture, durable in construction and easy to use.

Other objects, advantages and features of the present invention will become clear from the following detailed description when read in conjunction with the drawings and the appended claims.

DESCRIPTION

Figure 1:
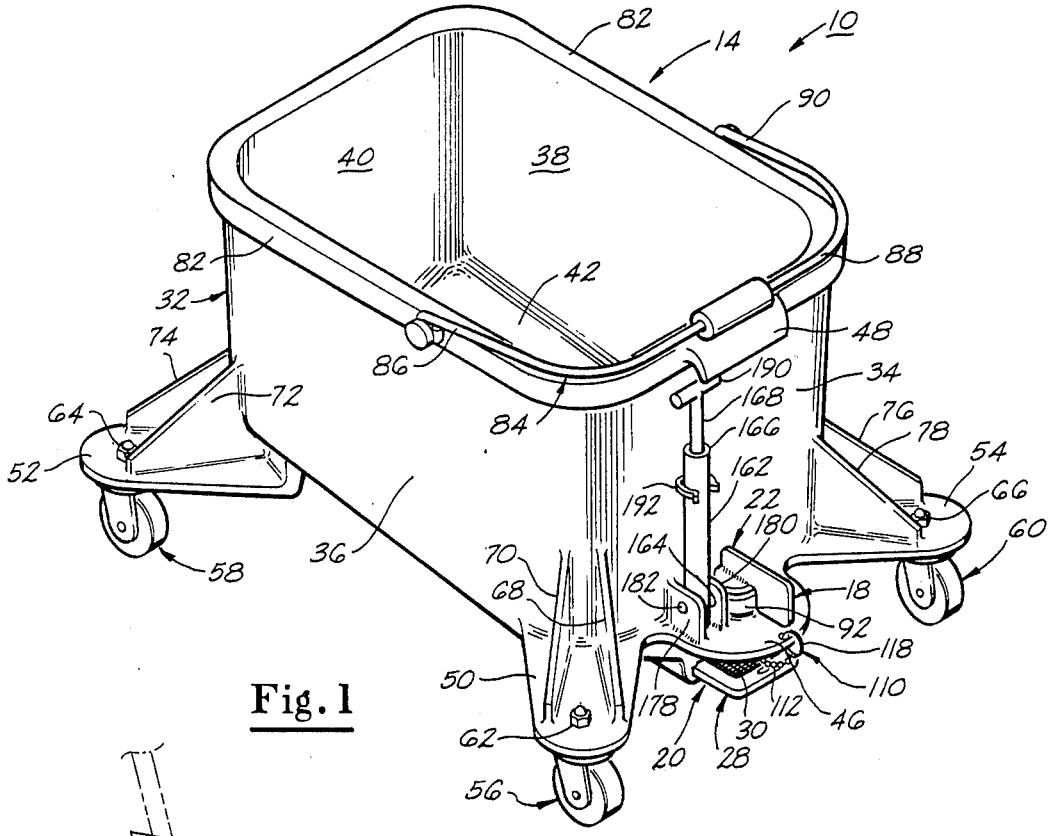
FIG. 1 is an upper perspective view of a portable cleaning station constructed in accordance with the present invention.
Figure 2:
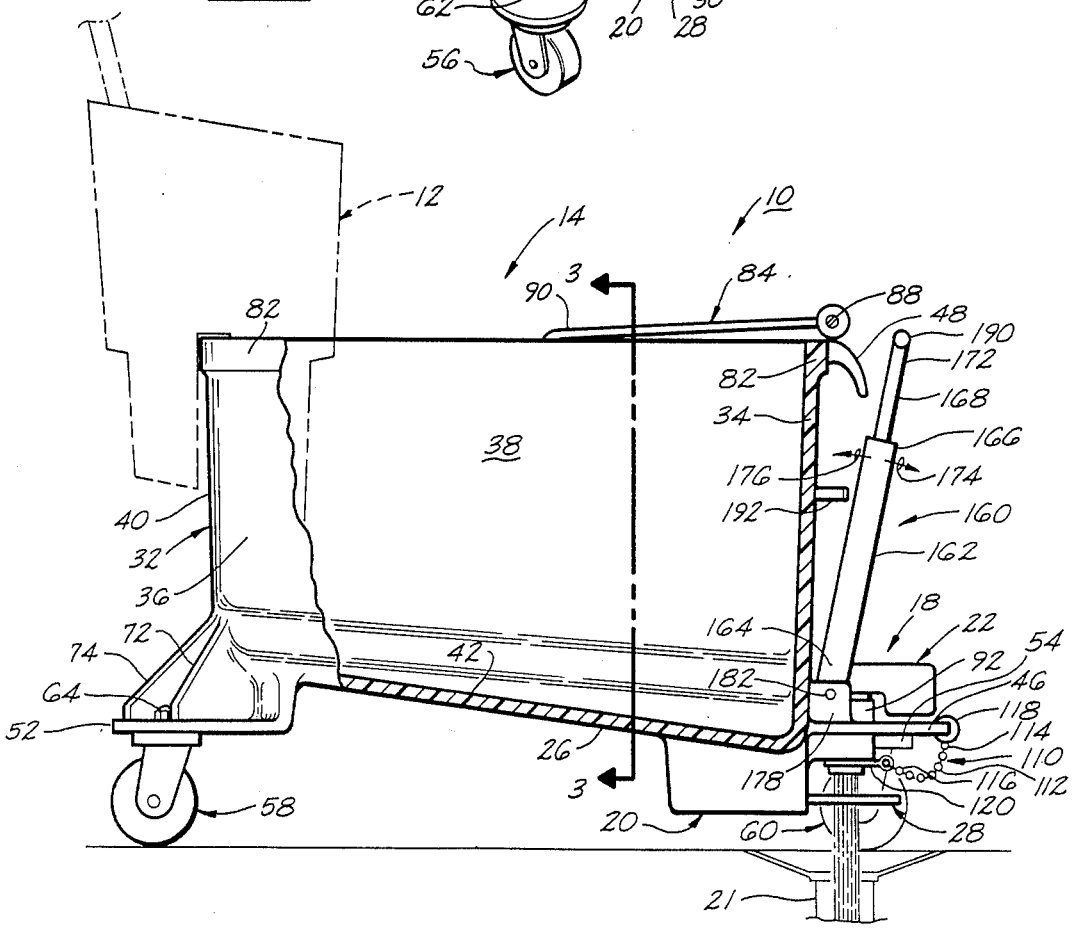
FIG. 2 is a partial cutaway, side view of the portable cleaning station of FIG. 1 illustrating, by phantom lines, a conventional wringer assembly supported on one end thereof.

Referring now to the drawings, and particularly to FIGS. 1 and 2, shown therein is a portable cleaning station 10 which may be used with a wringer 12 (shown by phantom lines in FIG. 2) supported on one end of the cleaning station 10. The wringer 12 is of conventional construction, and is of the type employed to wring or squeeze excess cleaning solution from a mop (not shown). No comments are deemed necessary concerning the wringer 12 in order for one to understand the portable cleaning station 10 of the present invention.

The portable cleaning station 10 comprises a bucket assembly 14 having a drain opening 16 (see FIG. 5); a valve assembly 18 supported by the bucket assembly 14 so as to communicate with the drain opening 16 for selectively opening and closing the drain opening 16; and a filter assembly 20 supported by the bucket assembly 14 for removing insoluble debris from the cleaning solution discharged from the bucket assembly 14 via the drain opening 16 and the valve assembly 18 to a selected disposal receptacle 21.

Figure 4:
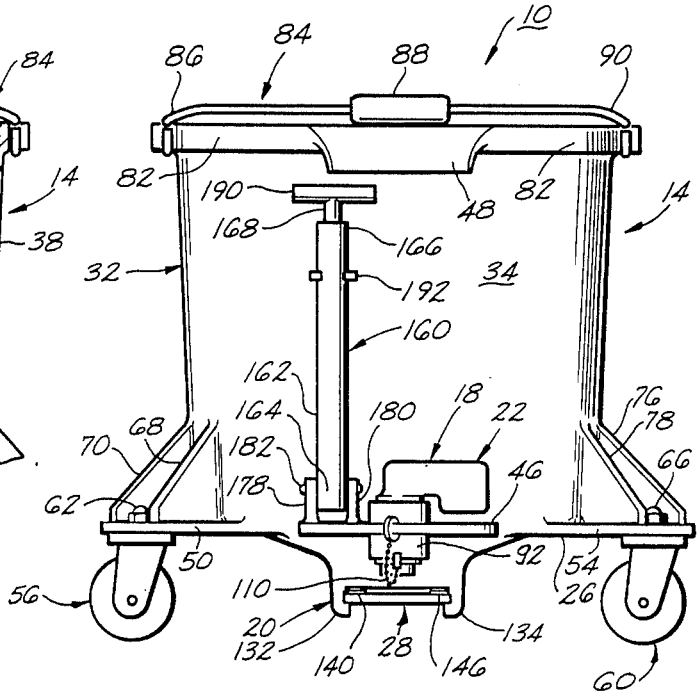
FIG. 4 is a front elevational view of the portable cleaning station.

The valve assembly 18 is provided with a drain spigot 22 (FIG. 7) having a drain bore 24 extending therethrough. The drain bore 24 communicates with the drain opening 16 of the bucket assembly 14 when the drain spigot 22 is in an open position (FIG. 5) so that solution in the bucket assembly 14 can be discharged therefrom in a substantially downward path (FIG. 2) via the drain opening 16 and the drain bore 24. On the other hand, when the drain spigot 22 is in a closed position (FIG. 4), the drain spigot 22 forms a fluid-tight seal with the drain opening 16 so that cleaning solution is retained in the bucket assembly 14.

Figure 6:
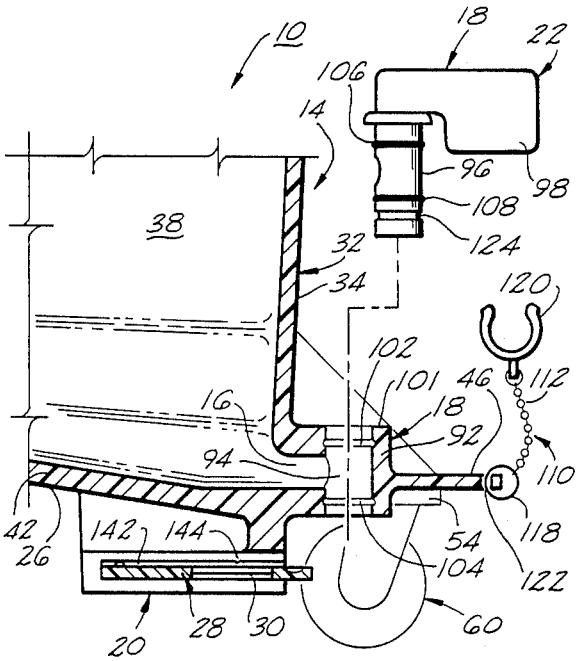
FIG. 6 is a fragmentary, cross-sectional view of the portable cleaning station wherein a valve spigot of the valve assembly has been removed.

The filter assembly 20, which is supported by the bucket assembly 14 at an underside 26 thereof, is provided with a filter member 28 having a liquid permeable member or filter element 30 disposed in one end portion thereof. The filter member 28 is selectively movable between an extended position (FIG. 2) and a retracted position (FIG. 6). In the extended position, the liquid permeable member 30 of the filter member 28 is disposed in a filtering relationship to the downward path of solution discharged from the bucket assembly 14 via the drain opening 16 and the drain bore 24 of the drain spigot 22. In the retracted position, the filter member 28 is disposed in a protected position beneath the bucket assembly 14.

Referring now to FIG. 1, the bucket assembly 14 comprises a body portion 32 having a front wall 34, spatially disposed side walls 36, 38, a rearward wall 40 and a bottom portion 42.

Figure 3:
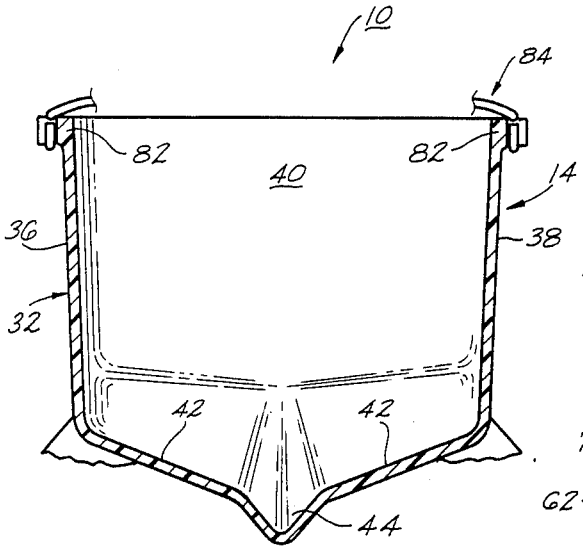
FIG. 3 is a cross-sectional view of the portable cleaning station taken at 3—3 in FIG. 2.

As best shown in FIGS. 2 and 3, the side walls 36, 38, and the rearward wall 40, are inwardly inclined in the direction of the bottom portion 42; and the bottom portion 42 is inclined or sloped downwardly in the direction of the front wall 34 to form a forwardly extending trough 44. Thus, the elongated cross-sectional configuration of the body portion 32 as shown in FIG. 2 is that of a trapezium.

In order to insure proper drainage of the cleaning solution from the body portion 32, the trough 44 formed by the bottom portion 42 slopes downwardly towards the drain opening 16. The trough 44 (see FIG. 3) extends from the junction of the rearward wall 40 and the bottom portion 42 to the drain opening 16. That is, the trough 44 extends substantially the length of the bottom portion 42 and the lowermost portion of the trough 44 communicates with the drain opening 16 of the body portion 32 of the bucket assembly 14.

The bucket assembly 14 further comprises a first bumper guard member 46 supported by the front wall 34 of the body portion 32 so as to extend forward of the valve assembly 18, a second bumper guard member 48 supported by the front wall 34 of the body portion 32 so as to be disposed above the first bumper guard member 46, substantially as shown, and four leg members supported by the body member 32. Only three of the leg members, i.e. leg members 50, 52 and 54, are shown in FIG. 1.

The first bumper guard member 46 protects the valve assembly 18 from damage by objects striking the valve assembly 18 as the cleaning station 10 is moved along the floor or supporting surface; and the second bumper guard member 48 protects the valve assembly 18 from damage due to inadvertent striking forces on the valve assembly 18 from over hanging objects as the cleaning station 10 is moved along the floor or supporting surface. Further, the second bucket bumper guard member 48 functions as handle so that the cleaning solution can be dumped from the body portion 32 of the bucket assembly 14, if one chooses, rather than draining the cleaning solution from the body portion 32 via the drain bore 24 and the drain spigot 22.

Each of the leg members of the bucket assembly 14, such as leg members 50, 52 and 54, desirably extends outwardly from a corner of the body portion 32. The positioning of the leg members, such as leg members 50, 52 and 54, relative to the body portion 32 (as shown), improves the stability of the body portion 32 as the cleaning station 10 is moved along the floor or supporting surface via a plurality of wheel or castor assemblies, such as wheel assemblies 56, 58 and 60, connected to a distal end portion of each of the leg members.

The wheel assemblies, such as wheel assemblies 56, 58 and 60, can be connected to the leg members of the bucket assembly 14, such as leg members 50, 52 and 54, respectively, by any suitable means, such as by positioning a threaded shank (not shown) of each the wheel assemblies through an aperture (not shown) in the distal end portion of each of the leg members and securing the wheel assembly to the respective leg member via nuts 62, 64 and 66. When attached to the leg members the wheel assemblies are freely rotatable and pivotable to permit selectively directional movement of the cleaning station 10 along the floor or supporting surface. The wheel assemblies of the bucket assembly 14, such as wheel assemblies 56, 58 and 60, are of conventional construction, so no further comments are deemed necessary concerning such wheel elements for one to understand the portable cleaning station 10 of the present invention.

To reinforce and strengthen the leg members of the body portion 32 of the bucket assembly 14, a plurality of brace members extended between the body portion 32 and each of the leg members of the bucket assembly 14, such as brace members 68, 70 extending between the body portion 32 and the leg member 50, brace members 72, 74 extending between the body portion 32 and the leg member 52, and brace members 76, 78 extending between the body portion 32 and the leg member 54. It should further be noted that the body portion 32, the first bumper guard member 46, the second bumper guard member 48, each of the leg members, such as leg members 50, 52 and 54, and each associated brace member for the leg members, are desirably fabricated of a polymeric material and of unitary construction. However, while it is preferred that the components described be formed of a polymeric material so as to be of unitary construction, one can readily fabricate each of the elements as individual components for connection therebetween without departing from the scope of the present invention.

The bucket assembly 14 further comprises a rim member 82 and a handle member 84. The rim member 82, which extends about an uppermost portion of the body portion 32, provides reinforcement to the uppermost portion of the body portion 32, and assists in stabilizing the wringer (shown by phantom lines in FIG. 2) on the rearward end of the body portion 32.

The handle member 84 is pivotally connected to the body portion 32 via the rim member 82. The handle member 84 is illustrated as a substantially U-shaped member having a first end 86, a medial portion 88 and a second end 90. The first end 86 is pivotally connected to the body portion 32 via the rim member 82; and the second end 90 is pivotally connected to the body portion 32 via the rim member 82 so as to be substantially aligned with the first end 86. Thus, the handle member 84 is selectively movable between a first position and a second position. In the first position the handle member 84 is disposed above the body portion 32 of the bucket assembly 14 so that a person can grasp the medial portion 88 of the handle member 84 for lifting the cleaning station 10. In the second position, the handle member 84 is disposed adjacent and supported by the rim member 82 substantially as shown.

Any suitable means can be employed for pivotally connecting the first end 86 and the second end 90 of the handle member 84 to the body portion 32 of the bucket assembly 14. The only requirement is that the attachment of the handle member 84 to the bucket assembly 14 permits the desired movement of the handle member 84 between the before-mentioned first and second positions.

Figure 5:
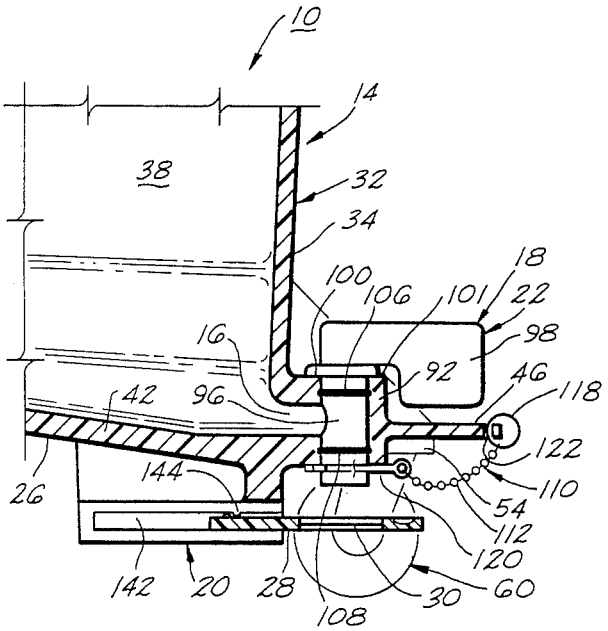
FIG. 5 is a fragmentary, cross-sectional side elevational view of the portable cleaning station of FIG. 1 wherein its valve assembly is illustrated in an open position.

As more clearly shown in FIGS. 5 and 6, the valve assembly 18 comprises a valve body 92 and the drain spigot 22. The valve body 92 is supported by the front wall 34 of the body portion 32 such that the first bumper guard member 46 extends forward of the valve body 92 and the drain spigot 22 substantially as shown.

The valve body 92 is provided with a bore 94 (FIG. 6) extending therethrough. The bore 94 is in fluid communication with the drain opening 16 of the body portion 32 of the bucket assembly 14. The drain spigot 22 is positionable within the drain bore 94 such that the drain spigot 22 can be selectively rotated therein between the open position and the closed position. The valve body 92 is preferably formed as an unitary part of the first bumper guard member 46 of the bucket assembly 14, substantially as shown.

Figure 7:
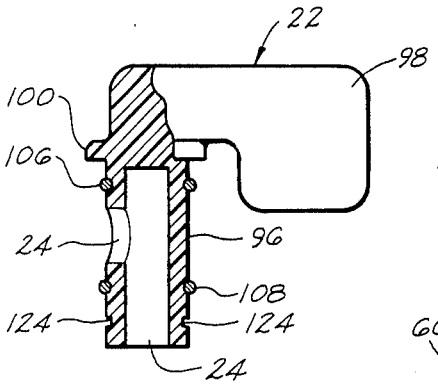
FIG. 7 is a partial cutaway view of the valve spigot of the valve assembly.

Referring now to FIG. 7, the drain spigot 22 of the valve assembly 18 comprises a drain spigot stem 96 positionable within the bore 94 of the valve body 92, and a substantially normally disposed handle member 98 for grasping by a user's hand to selectively move the drain spigot stem 96 between the open position and the closed position within the valve body 92. The drain spigot stem 96, which contains the drain bore 24, is provided with a rim portion 100 adapted to engage and be supported by an upper end 101 of the valve body 92 defining the bore 94.

In order to provide a fluid-tight seal between the drain spigot stem 96 and the valve body 92, a recessed portion 102 is formed in the valve body 92 so as to be disposed a distance above the drain opening 16 of the body member 32; and a recessed portion 104 is formed in the valve body 92 so as to be disposed a distance below the drain opening 16 of the body member 32. The recessed portions 102, 104 are each adapted to receive a sealing member, such as O-rings 106, 108, supported by the drain spigot stem 96 substantially as shown. Thus, the drain spigot stem 96 can be readily moved between the open position and the closed position within the drain bore 94 of the valve body 92 so that the cleaning solution can be selectively drained from the body portion 32 of the bucket assembly 14, or retained therein, depending on whether the drain spigot stem 96 is in the open or closed position.

In order to prevent the inadvertent or unintentional removal of the drain spigot stem 96 from the bore 94 of the valve body 92 when the drain spigot stem 96 is moved between the open position and the closed position, the cleaning station 10 further comprises a connector assembly 110 extending between and connected to the first bumper guard member 46 and the drain spigot stem 96. The connector assembly 110 comprises a chain member 112 having a first end 114 and an opposed second end 116. A ring member 118 is connected to the first end 114 of the chain member 112; and a resilient, substantially U-shaped clamp member 120 is connected to the second end 116 of the chain member 112.

The ring member 118 is connected to a to the first bumper guard member 46 via an aperture 122 formed therein; and the resilient U-shaped clamp member 120 is connected to a lower end portion of the drain spigot stem 96 extending below the valve body 92 via a groove 124 formed in the lower end portion of the drain spigot stem 96. Thus, the connection of the chain member 112 to the drain spigot stem 96 and the first bumper guard member 46 prevents the inadvertent removable of the drain spigot stem 96 from the valve body 92.

Figure 8:
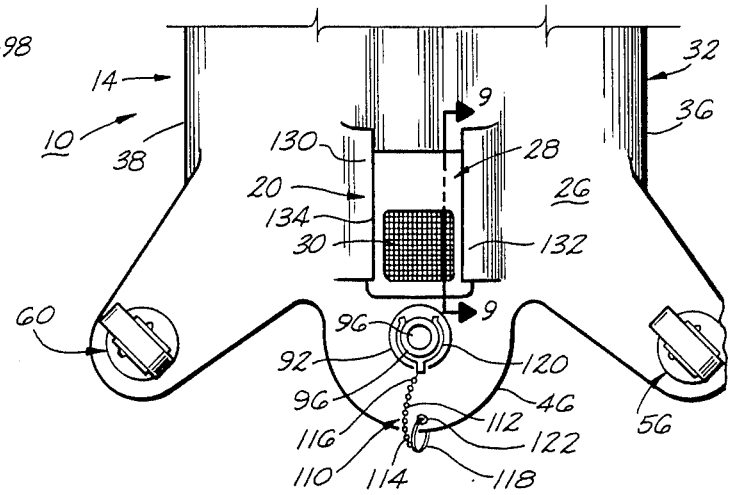
FIG. 8 is a fragmentary, bottom plan view of the portable cleaning station showing its retractable filter assembly.
Figure 9:
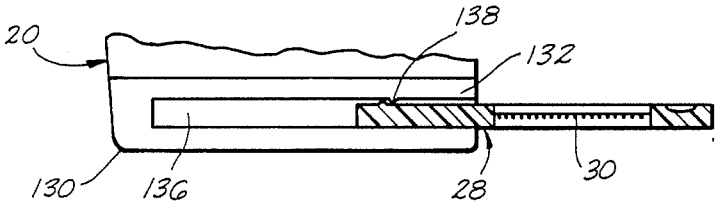
FIG. 9 is a fragmentary view of the filter assembly taken at 9—9 in FIG. 8.
Figure 10:
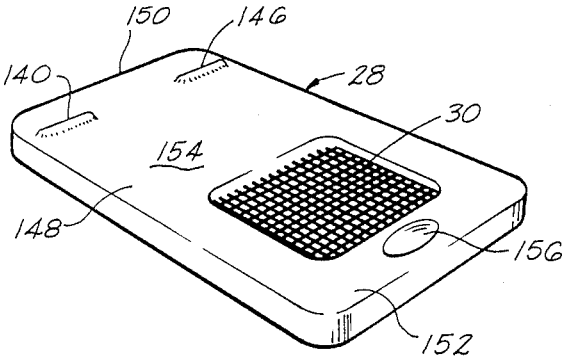
FIG. 10 is an upper perspective view of the filter member of the filter assembly.

Referring now to FIGS. 8–10, the filter assembly 20 of the cleaning station 10 comprises a filter housing 130 supported by the underside 26 of the bottom portion 42 of the body member 32, and the filter member 28. The filter housing 130 defines a passageway for receiving and supporting the filter member 28 such that the filter member 28 can be selectively moved between the extended position and the retracted position.

The filter housing 130 comprises a pair of substantially parallel, spatially disposed track members 132, 134. The track member 132 is provided with an elongated slot 136 for slidably receiving and supporting one edge portion of the filter member 28. The track member 132 is also provided with a stop member 138 adapted to engage a stop member 140 of the filter member 28 to prevent inadvertent removal of the filter member 28 from the elongated slot 136 of the track member 132 when the filter member 28 is moved to the extended position.

Similarly, the track 134 is provided with an elongated slot 142 (see FIGS. 5 and 6) for slidably receiving and supporting an opposite edge portion of the filter member 28. The track member 134 is also provided with a stop member 144 adapted to engage a stop member 146 of the filter member 28 to prevent inadvertent removal of the filter member 28 from the elongated slot 142 of the track member 134 when the filter member 28 is moved to the extended position.

Referring now to FIG. 10, the filter member 28 is illustrated as an elongated member 148 having a first end portion 150 and an opposed second end portion 152. The stop members 140, 146 of the filter member 28 are disposed on an upper side 154 of the first end portion 150 of the elongated member 148 substantially as shown. The liquid permeable member or filter element 30 of the filter member 28 is positioned in the opposed second end 152 such that when the filter member 28 is in the extended position, the liquid permeable member 30 is in a filtering relationship with cleaning solution being discharged from the bucket assembly 14 via the valve assembly 18.

An indentation 156 is formed in the second end portion 152 of the filter member 28 so as to be in close proximity to the liquid permeable member 30. The indentation 150 assists a person in selectively moving the filter member 28 between the extended position and the retracted position.

Any suitable material can be used in the fabrication of the fluid permeable member or filter element 30 of the filter member 28, provided that such material has sufficient porosity to permit the flow of cleaning solution therethrough when the drain spigot stem 96 is in the open position for draining the cleaning solution from the body member 32 of the cleaning station 10, while at the same time having sufficient structural strength to separate and capture insoluble particulate materials from the cleaning solution passing through the fluid permeable member 30 of the filter member 28.

Referring again to FIGS. 1 and 2, the cleaning station 10 further comprises a pull-handle assembly 160 pivotally supported by the bucket assembly 14. The pull-handle assembly 160 is selectively movable between a first position and a second position. In the first position, the pull-handle assembly 160 is disposed in a vertical position substantially adjacent the front wall 34 of the body member 32; and in the second position the pull-handle assembly 160 extends forward from the front wall 34 of the body portion 32. Thus, in the second position one can grasp the pull-handle assembly 160 for pulling the cleaning station 10 over a floor or supporting surface.

Figure 11:
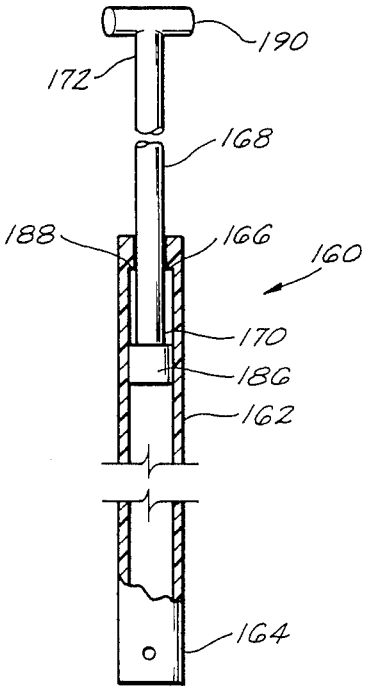
FIG. 11 is a partial cutaway, cross-sectional view of the handle assembly of the portable cleaning station.

As more clearly shown in FIG. 11, the pull-handle assembly 160 comprises a tubular housing member 162 having a first end 164 and a second end 166, and an extendable member 168 having a first end 170 and an opposed second end 172. The extendable member 168 is telescopically received by the tubular housing member 162 such that the extendable member 162 is selectively movable between an extended position and a retracted position. In the extended position of the extendable member 168, the tubular housing member 162 and the extendable member 168 cooperates to provide the pull-handle assembly 160 with a sufficient length so that one can readily grasp the extendable member 168 and move the cleaning station 10 from one location to another. However, in the retracted position the extendable member 168 is disposed within the tubular housing member 162 so that the pull-handle assembly 160 can be secured in a stowed position substantially adjacent the front wall 34 of the body portion 32.

The tubular housing member 162 can be secured to the front wall 34 of the body portion 32 by any suitable means, provided that the tubular housing member 162 is selectively movable in a to and fro direction as indicated by the arrows 174, 176 (FIG. 2). For example, a pair of spatially disposed lugs 178, 180 can be connected to and supported by the front wall 34 and the first bumper guard member 46 (FIG. 1), and the first end 164 of the tubular housing member 162 can be pivotally connected therebetween via a pivot pin 182. By connecting the tubular housing member 162 to the spatially disposed lugs 178, 180, as described, the tubular housing member 162 and the tubular housing member 162 and the extendable member 168 are positionable below the second bumper guard member 48 for storage when the extendable member 168 is in the retracted position and the pull-handle assembly 160 is in the first position.

To prevent inadvertent removal of the extendable member 168 from the tubular housing member 162 when the extendable member 168 is moved to the extended position, a stop member 186 is connected to the first end 170 of the extendable member 168 substantially as shown. The stop member 186 engages a shoulder 188 formed in the second end 166 of the tubular housing member 162 when the extendable member 168 is in the extended position.

The pull-handle assembly 160 further comprises a pull-handle member 190 supported by the opposed second end 172 of the extendable member 168. The pull-handle member 190 is adapted to be graspable by the hand of a person for selectively moving the extendable member 168 between the extended position and the retracted position, and for pulling the portable cleaning station 10 along the floor or supporting surface when the extendable member 168 is in the extended position.

In order to secure the tubular housing member 162 in the substantially vertically disposed first position adjacent the front wall 34 of the body member 32, a resilient clip member 192 is connected to the front wall 34 of the body member 32 for frictionally engaging and securing the tubular housing member 162 to the front wall 34.

The portable cleaning station 10 of the present invention permits one to readily clean a floor and thereafter disposed of the contaminated cleaning solution without any substantial contact with the cleaning solution or substances being cleaned from the floor. Further, the portable cleaning station 10 can be sanitized without requiring the user to lift the portable cleaning station 10 to remove insoluble materials therefrom.

In order to assist one in a more complete understanding and appreciation of the portable cleaning station 10 a brief description of its use will be hereinafter set forth. To use the portable cleaning station 10 one first inspects the assembly 18 to insure that the drain spigot 22 is in the closed position. Thereafter, cleaning solution is introduced into the body portion 32 of the bucket assembly 14; and the wringer 12 is positioned on the rearward wall 40 of the body portion 32. The mop (not shown, but of conventional construction) is wetted in the cleaning solution and thereafter placed in the wringer 12 so that excess cleaning solution can be removed from the mop.

When it is desired to move the cleaning station 10 from one location to another, one disengages the tubular housing member 162 from the resilient clip member 192, grasps the pull-handle 190, and extends the extendable member 168 until the stop member 186 of the extendable member 168 engages the shoulder 188 formed in the second end 166 of the tubular housing member 162. Thereafter, the portable cleaning station 10 can be moved to the desired location via the wheel assemblies, such as wheel assemblies 56, 58 and 60, by applying a pulling force on the pull-handle 190. It should be noted that the first bumper guard member 46 and the second bumper guard member 48 supported by the front wall 34 of the body portion 32 protect the valve assembly 18 from damage as the portable cleaning station 10 is moved from one location to another.

When the cleaning station 10 has been moved to the desired location, such as adjacent a disposal receptacle 21, the extendable member 168 can be telescopically disposed with the tubular housing member 162 so that the extendable member 168 is in its retracted position. The tubular housing member 162 can then be secured to front wall 34 of the body portion 32 via engagement with the resilient clip member 192.

To drain the cleaning solution from the body portion 32 one first positions the filter member 28 in the extended position so that the liquid permeable member or filter element 30 is disposed below the valve assembly 18 and in a filtering relationship with the cleaning solution discharged via the drain opening 16 of the bucket assembly 14 and the valve assembly 18. Thereafter, the drain spigot stem 96 is moved to the open position so that the cleaning solution is discharged therethrough, filtered by the liquid permeable member 30 of the filter member 28 to remove soluble materials, and discharged into the disposed receptacle 21.

When the cleaning solution has been drained from the body portion 32 of the bucket assembly 14, a portion of particulate materials may still be present, especially in the trough 44 formed in the bottom portion 42 of the body portion 32. Because of the unique design of the body portion 32, including the through 44, residual particulate materials can generally be removed by squeezing additional cleaning solution from the mop via the wringer 12, or by pouring a small amount of a liquid into the body portion 32 of the bucket assembly 14 to flush any residual particulate material from the trough 44.

From the above description, it is clear that the present invention is well adapted to carry out the objects and to attain the ends and advantages mentioned hereinabove, as well as those inherent within the present invention. While a preferred embodiment of the invention has been described for the purpose of this disclosure, numerous changes can be made which will readily suggest themselves to those skilled in the art and which are encompassed within the spirit and scope of the invention disclosed herein and as defined in the appended claims.

What is claimed is:

1. An improved portable cleaning station comprising:

bucket means for containing a cleaning solution, the bucket means having a drain opening at its lowermost portion;

valve means supported by the bucket means and communicating with the drain opening for selectively opening and closing the drain opening, the valve means having a drain spigot having a drain bore therein, the drain bore openly communicating with the drain opening of the bucket means when the valve means is in an open position such that cleaning solution in the bucket means is discharged from the bucket means in a substantially downward path via the drain opening and the drain bore, the drain spigot forming a substantially fluid-tight seal with the drain opening when the valve means is in a closed position such that cleaning solution is retained in the bucket means; and filter means supported by the underside of the bucket means for removing insoluble debris from the cleaning solution discharged through the drain opening and the drain bore, the filter means selectively movable between an extended position and a retracted position, in the extended position the filter means being disposed in a filtering relationship to the downward path of discharging cleaning solution, in the retracted position the filter means being disposed in a protected position beneath the bucket means.

2. The portable cleaning station of claim 1 wherein the filter means comprises:

a pair of substantially parallel, spatially disposed track members supported by the underside of the bucket means; and a filter member supported by the track members such that the filter member is selectively movable between the extended position and the retracted position.

3. The portable cleaning station of claim 2 wherein the bucket means comprises:

a body portion having a front wall, spatially disposed side walls, a rearward wall and a bottom, the bottom being sloped in a downwardly extending direction from each of the side walls and the rearward wall in the direction of the drain opening.

4. The portable cleaning station of claim 3 wherein the bucket means further comprising:

first bumper guard means supported by the front wall of the body portion so as to extend forward of the valve means for protecting the valve means as the cleaning station is moved.

5. The portable cleaning station of claim 4 wherein the bucket means further comprising:

wheel means connected to the body portion of the bucket means for supporting the body portion on a supporting surface and for permitting selective movement of the cleaning station along the supporting surface.

6. The portable cleaning station of claim 5 wherein the bucket means further comprising:

at least one substantially U-shaped handle member having a first end, a medial portion and a second end, the first end pivotally connected to one of the side walls of the body portion and the second end pivotally connected to the opposite side wall of the body portion such that the handle member is movable between a first position and a second position, in the first position the handle member being disposed above the body portion for lifting, in the second position the handle member being disposed adjacent and supported by an upper edge portion of one of the front and rearward walls of the body portion.

7. The portable cleaning station of claim 6 further comprising:

connector means extending between and connected to the first bumper guard means and the valve means for stabilizing the drain spigot as same is moved between the open position and the closed position, and for preventing unintentional removal of the drain spigot.

8. The portable cleaning station of claim 7 further comprising:

a pull-handle assembly pivotally supported by the first bumper guard means, the pull-handle assembly selectively movable between a first position and a second position, in the first position the pull-hand assembly being disposed in a substantially vertical position adjacent the front wall of the body portion, in the second position the pull-handle assembly extending in a forward direction from the front wall of the body portion.

9. The portable cleaning station of claim 8 wherein the pull-handle assembly comprises:

a tubular housing member having a first closed end and an open second end, the first closed end connected to the bumper guard means such that the tubular housing member is selectively movable in a to and fro direction;

an extendable member having a first end and an opposed second end, the extendable member telescopically received by the tubular housing member such that the opposed second end of the extendable member is selectively movable between an extended position and a retracted position;

stop means supported by the first end of the extendable member for preventing removal of the extendable member from the tubular housing member as the extendable member is moved to the extended position; and a handle member supported by the opposed second end of the extendable member, the handle member graspable by a hand for selectively moving the extendable member between the extended position and the retracted position and for pulling the portable cleaning station along the supporting surface.

10. The portable cleaning station of claim 9 further comprising:

clip means supported by the front wall of the body portion for securing the tubular housing in a substantially vertical stored position adjacent the front wall of the body portion.

11. The portable cleaning station of claim 10 wherein the bucket means further comprises:

a reinforcing rim member disposed about an upper portion of the body portion.

12. The portable cleaning station of claim 11 wherein the bucket means further comprises:

second bumper guard means supported by the front wall of the body portion so as to extend forward of the valve means for protecting the valve means from inadvertent striking forces directed at same as the cleaning station is moved, the second bumper guard means disposed in a spatial relationship above the first bumper guard means.

13. An improved portable cleaning station comprising:

bucket means for containing a cleaning solution, the bucket means having an angularly disposed bottom with a drain opening at its lowermost portion, the angularly disposed bottom defining a drain trough communicating with the drain opening;

valve means supported by the bucket means and communicating with the drain opening for selectively opening and closing the drain opening, the valve means comprising a valve body and a drain spigot stem supported by the valve body and having a drain bore therein, the drain bore openly communicating with the drain opening of the bucket means when the drain spigot stem is in an open position such that cleaning solution in the bucket means is discharged from the bucket means in a substantially downward path via the drain opening and the drain bore, the drain spigot forming a substantially fluid-tight seal with the drain opening when the drain spigot stem is in a closed position such that cleaning solution is retained in the bucket means;

filter means supported by the bucket means for removing insoluble debris from the cleaning solution discharged through the drain opening and the drain bore, the filter means selectively movable between an extended position and a retracted position, in the extended position the filter means being disposed in a filtering relationship the downward path of discharging cleaning solution, in the retracted position the filter means being disposed in a protected position beneath the bucket means; and wheel means connected to the bucket means for supporting the bucket means on a supporting surface and for permitting selective movement of the cleaning station along the supporting surface.

14. The portable cleaning station of claim 13 further comprising:

a pull-handle assembly pivotally supported by the bucket means, the pull-handle assembly selectively movable between a first position and a second position, in the first position the pull-hand assembly being disposed in a substantially vertical position adjacent the bucket means in the second position the pull-handle assembly extending in a forward direction from the bucket means.

15. The portable cleaning station of claim 14 wherein the pull-handle assembly comprises:

a tubular housing member having a first closed end and an open second end, the first closed end pivotally connected to the bucket means such that the tubular housing member is selectively movable in a to and fro direction;

an extendable member having a first end and an opposed second end, the extendable member telescopically received by the tubular housing member such that the opposed second end of the extendable member is selectively movable between an extended position and a retracted position;

stop means supported by the first end of the extendable member for preventing removal of the extendable member from the tubular housing member as the extendable member is moved to the extended position; and a handle member supported by the opposed second end of the extendable member, the handle member graspable by a hand for selectively moving the extendable member between the extended position and the retracted position and for pulling the portable cleaning station along the supporting surface.

16. The portable cleaning station of claim 15 further comprising:

clip means supported by the bucket means for securing the tubular housing in a substantially vertical stored position adjacent the bucket means.

17. The portable cleaning station of claim 16 wherein the bucket means further comprising:

first bumper guard means supported by the bucket means so as to extend forward of the valve body for protecting the valve body and drain spigot stem as the cleaning station is moved.

18. The portable cleaning station of claim 17 wherein the bucket means further comprising:

second bumper guard means supported by the bucket means for protecting the valve body and drain spigot stem from inadvertent striking forces directed at same as the cleaning station is moved, the second bumper guard means disposed in a spatial relationship above the first bumper guard means.

19. The portable cleaning station of claim 18 wherein the bucket means further comprising:

at least one substantially U-shaped handle member having a first end, a medial portion and a second end, the first and second ends pivotally connected to the bucket means such that the handle member is movable between a first position and a second position, in the first position the handle member being disposed above the bucket means for lifting, in the second position the handle member being disposed adjacent and supported by the bucket members.

20. The cleaning station of claim 18 further comprising:

connector means extending between and connected to the first bumper guard means and the drain spigot stem for stabilizing the drain spigot stem as same is moved between one of the open position and closed position and for preventing unintentional removal of the drain spigot stem.

21. The portable cleaning station of claim 20 wherein the filter means comprises:

a pair of substantially parallel, spatially disposed track members supported by an underside of the bucket means; and a filter member supported by the track members such that the filter member is selectively movable between the extended position and the retracted position.

22. The portable cleaning station of claim 20 wherein the filter means comprises:

a filter housing supported by the under side of the bucket means, said filter housing having a filter receiving passageway therein; and a filter member supported within the filter receiving passageway, the filter member having a fluid permeable member positional in one end thereof, the filter member is selectively movable between the extended position and the retracted position, in the extended position the fluid permeable member disposed below the drain spigot stem and in a filtering relationship therewith, in the retracted position the filter member being disposed in the filter receiving passageway.

* * * * *